US005692655A

United States Patent [19]

Fair et al.

[11] Patent Number: 5,692,655

[45] Date of Patent: Dec. 2, 1997

[54] SOFT CARRIER FOR A CHILD

[75] Inventors: Paul F. Fair, Denver; Marjorie G. Harper, Littleton; Cynthia R. Nelson, Longmont, all of Colo.

[73] Assignee: Lisco, Inc., Tampa, Fla.

[21] Appl. No.: 552,581

[22] Filed: Nov. 3, 1995

[51] Int. Cl.[6] ..... A61G 1/00

[52] U.S. Cl. ..... 224/160; 224/581; 224/630

[58] Field of Search ..... 224/160, 161, 224/159, 158, 630

[56] References Cited

U.S. PATENT DOCUMENTS

| | | | |
|---|---|---|---|
| 1,198,423 | 9/1916 | De Lude et al. | 224/161 |
| 3,780,919 | 12/1973 | Hansson | 224/160 |
| 4,009,808 | 3/1977 | Sharp | 224/160 |
| 4,420,103 | 12/1983 | Douglass | 224/630 |
| 5,020,709 | 6/1991 | Hoaglan | 224/161 |
| 5,366,126 | 11/1994 | Dausien | 224/630 |

FOREIGN PATENT DOCUMENTS

| | | | |
|---|---|---|---|
| 123094 | 6/1944 | Australia | 224/161 |
| 2404414 | 6/1979 | France | 224/160 |

*Primary Examiner*—Linda J. Sholl

*Attorney, Agent, or Firm*—Robert G. Crouch; Chrisman, Bynum & Johnson, P.C.

[57] ABSTRACT

A soft child carrier including a soft body member attached to a relatively rigid back portion. A pair of shoulder straps are attached to the carrier adjacent to upper and lower ends of the back portion, and a waist belt extends from opposing sides of the lower end of the back portion. The relatively stiff back portion facilitates the transferring of the weight of a child to the waist belt such that a substantial portion of the child's weight is transferred away from the shoulder straps to thereby relieve the amount of weight carried on the shoulders and upper back of a person supporting the carrier. A seat adjustment is also provided whereby an adjustment strap extending along the back portion may be pulled or released to cause a height for the seat portion of the carrier to be increased or decreased depending on the size of the child. The carrier is further provided with a central partition which is movable between a front portion of the carrier and the back portion to accommodate a child in either a forward facing or rearward facing position.

11 Claims, 8 Drawing Sheets

SOFT CARRIER FOR A CHILD

BACKGROUND OF THE INVENTION

The present invention relates to child carriers, and more particularly, to a soft carrier which is adapted to hold a child in a forward facing or rearward facing direction.

A wide variety of child carriers are available and may generally be divided into the categories of soft carriers and frame carriers. Frame carriers have the advantages of providing controlled distribution of the weight of a child to the person supporting the carrier whereas soft carriers provide the advantages of a carrier which is easily adjusted to the body of the person supporting the carrier, and soft carriers typically have a compact structure which may be folded for easy storage when not in use.

One disadvantage associated with many soft carriers relates to the distribution of weight transferred to the person supporting the carrier. Specifically, a large portion of the child's weight is commonly transferred to shoulder straps for supporting the carrier such that a person's shoulders and back may become tired while wearing the carrier.

Further, while many child carriers may be adapted to support the child in either a forwardly or rearwardly facing direction, such carriers typically require that the carrier be removed and readjusted or re-configured when moving a child from a forwardly facing to a rearwardly facing direction or vice-versa.

Accordingly, there is a need for a soft child carrier which provides certain weight distribution advantages typically associated with frame carriers. Further, there is a need for such a carrier which is easily used and which provides for both forwardly facing and rearwardly facing orientations of a child within the carrier.

SUMMARY OF THE INVENTION

The present invention provides a soft carrier adapted to be supported on a person by a harness wherein a child may be placed in either a forwardly or rearwardly facing direction without removing the carrier from the person, and which also facilitates distribution of the child's weight to reduce fatigue to the person supporting the carrier.

The carrier of the present invention includes a soft body member defining a front portion and side portions forming a child receiving area. The side portions are connected to a back portion and a seat portion extends from a lower end of the front portion and is attached to the back portion. In addition, a central partition is provided extending through the child receiving area between the side portions of the soft body member.

The central partition is a relatively stiff member and includes flexure points to permit the central partition to be selectively moved into close association with either the front portion or the back portion. When the central partition is moved into association with the back portion, a first area is defined for receiving a child in a forwardly or outwardly facing position within the carrier. Alternatively, when the central partition is moved into association with the front portion, a second area is defined for receiving a child in a rearwardly or inwardly facing direction.

A waist belt is attached to a lower end of the back portion for extending around the waist of a person supporting the carrier, and the back portion is formed as a relatively stiff member to facilitate transferring the weight of a child in the carrier downwardly to the waist belt. In addition, shoulder straps are provided having first ends attached adjacent to an upper end of the back portion and second ends attached adjacent to the lower end of the back portion. Thus, weight from the child is distributed between the shoulder straps and the waist belt by the relatively stiff back portion.

Anti-lunge straps extend from the shoulder straps to a location on the front portion of the soft body member. The anti-lunge straps prevent a child from lunging outwardly away from the carrier and include means for adjusting the length to accommodate different size children.

The seat portion is also adjustable and includes an adjustment strap which extends upwardly through a loop located near the upper end of the back portion. The adjustment strap extends downwardly to an attachment location near the lower end of the back portion. The adjustment strap may be adjusted at the attachment location wherein pulling down on the adjustment strap causes the height of the seat portion to increase and releasing the adjustment strap to move upwardly causes the seat portion to be adjusted to a lower height.

Therefore, it is an object of the present invention to provide a child carrier wherein a child may be easily accommodated in either a forwardly facing or rearwardly facing direction.

It is a further object of the invention to provide a child carrier wherein an improved weight distribution is provided between shoulder straps and a waist belt for the carrier.

It is yet another object of the invention to provide a child carrier wherein a height for a seat portion of the carrier may be easily adjusted.

Other objects and advantages of the invention will be apparent from the following description, the accompanying drawings and the appended claims.

DETAILED DESCRIPTION OF THE PREFERRED EMBODIMENT

Figure 1:
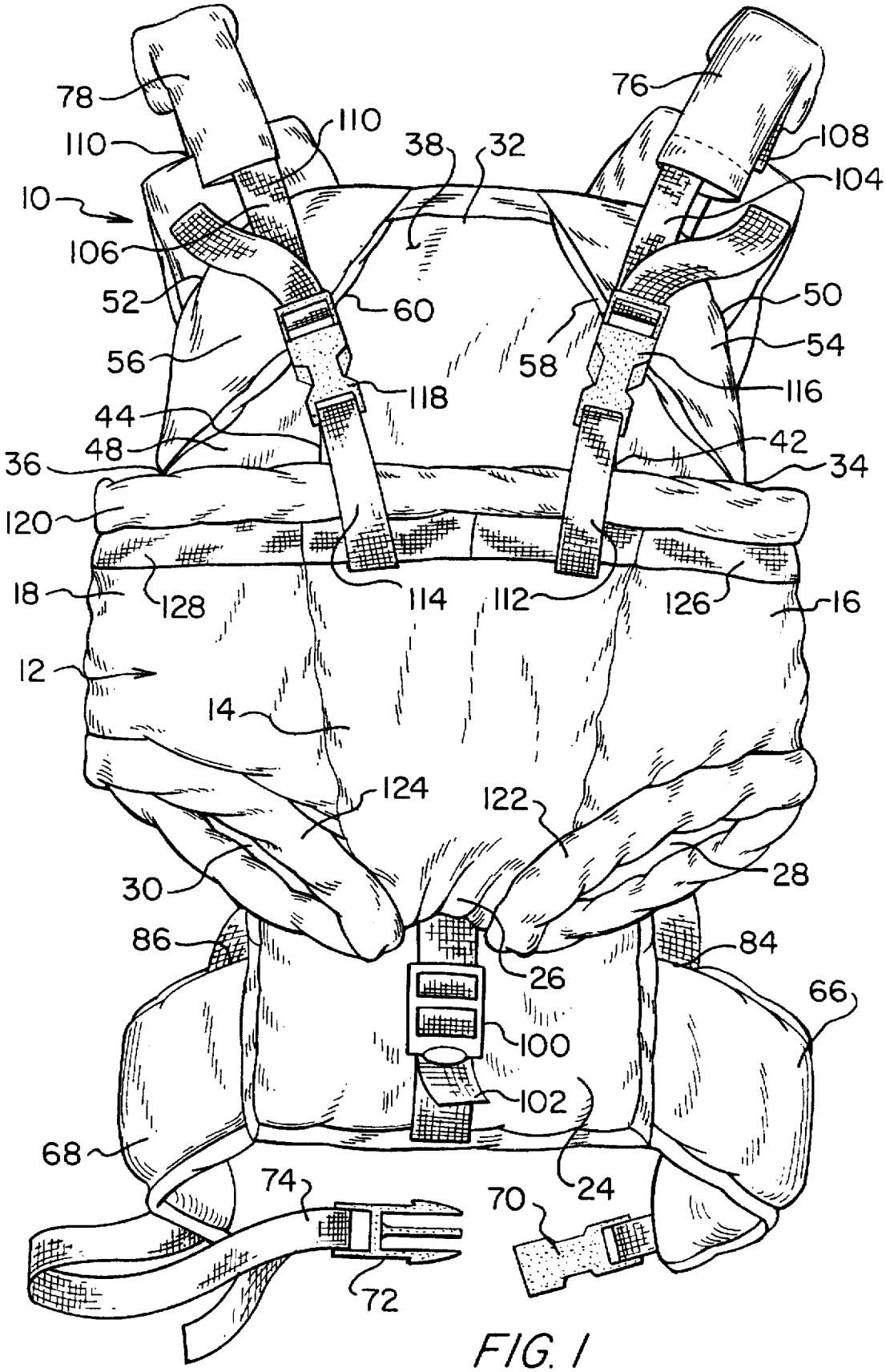
FIG. 1 is a front view of the child carrier of the present invention.
Figure 2:
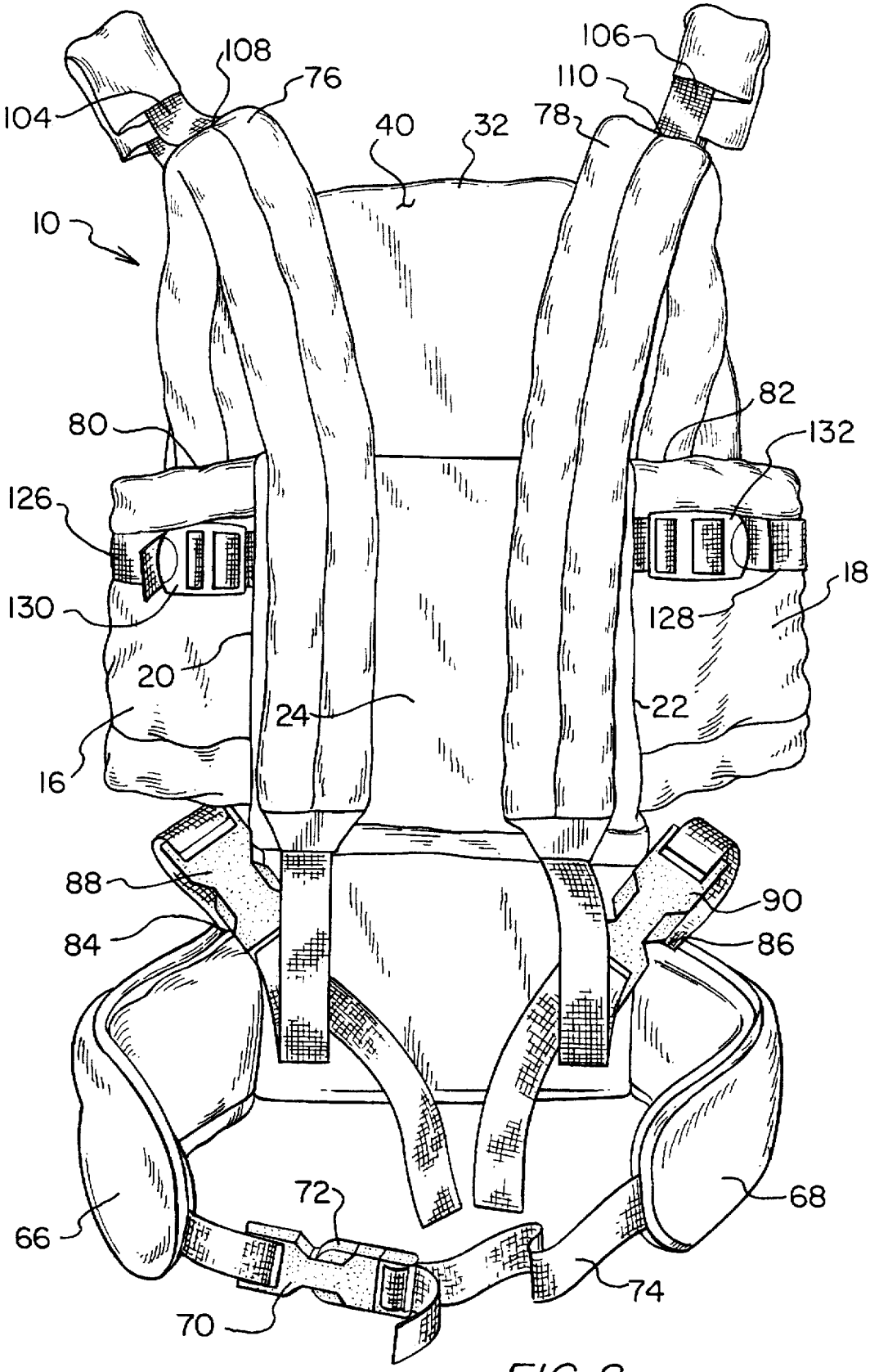
FIG. 2 is a rear view thereof.
Figure 3:
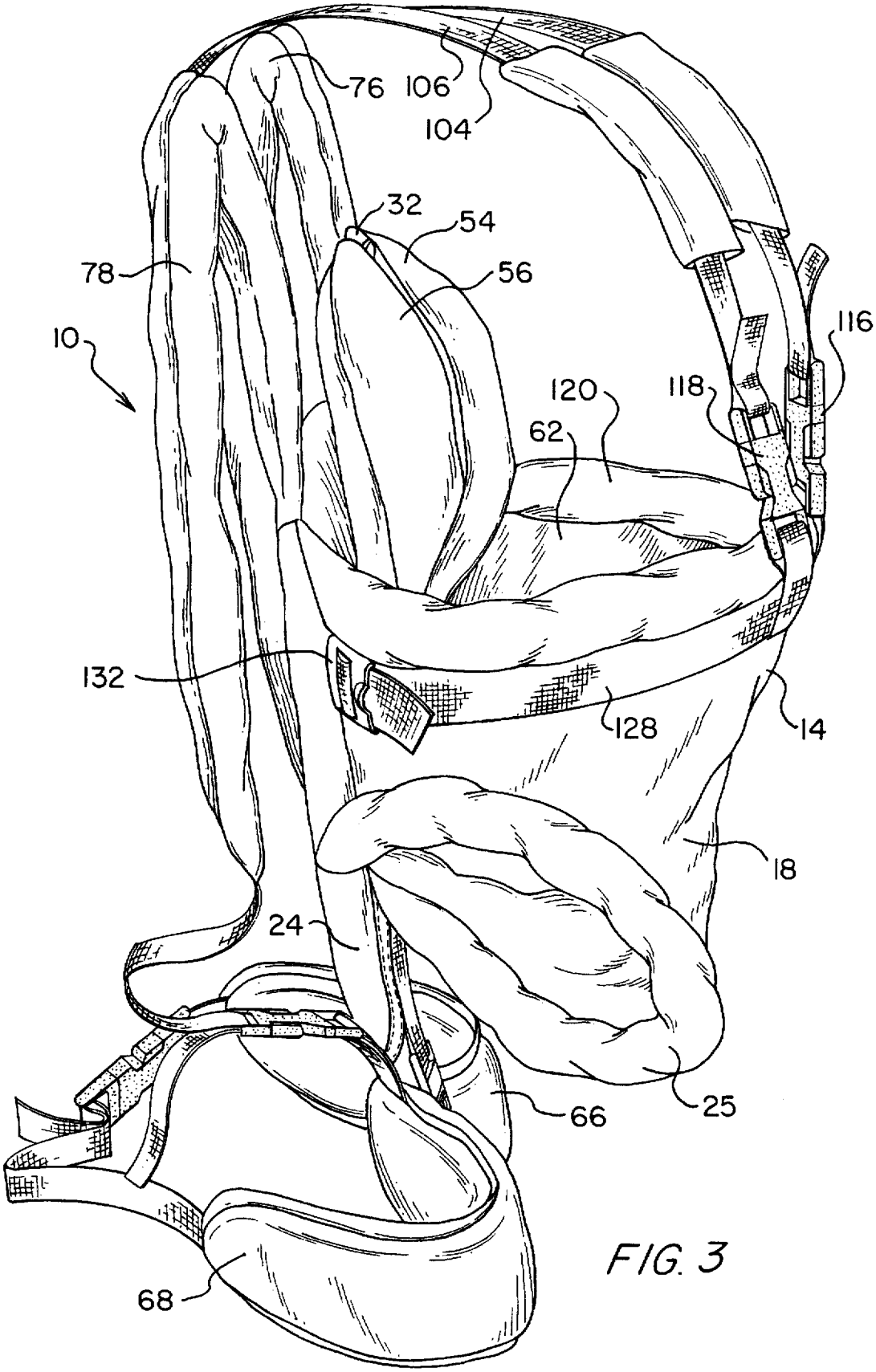
FIG. 3 is a side elevational view of the child carrier showing the central partition located for receiving a child in a forward facing position.

Referring to FIGS. 1–3, the child carrier 10 of the present invention is configured as a soft carrier and includes a soft body member 12 defining a front portion 14 and side portions 16, 18. The side portions 16, 18 are connected to opposing side edges 20, 22 of a back portion 24. The front portion 14 and side portions 16, 18 form a child receiving area in front of the back portion 24 to receive a small child, such as an infant.

A seat portion 26 extends from a lower end of the front portion 14 and is attached to the back portion 24. Openings 28, 30 are defined on either side of the seat portion 26 for receiving the legs of a child therethrough.

A central partition 32 extends through the child receiving area and includes side edges 34, 36 which are attached to the side portions 16, 18, respectively. The central partition 32 is formed as a relatively stiff member, and may be formed by a stiff padding material enclosed between a front fabric face 38 and a rear fabric face 40 of the partition 32.

The partition 32 includes flexure points 42, 44 extending vertically along the length of the partition 32 whereby wing portions 46 and 48 are defined between the respective flexure points 42, 44 and the side edges 34, 36. The wing portion 46 includes an upper corner 50, and the wing portion 48 includes an upper corner 52. Each of the upper corners 50, 52 is provided with a respective head bolster member 54, 56 comprising a pad which overlies a portion of the face 38. Each of the bolster members 54, 56 includes an edge common to an edge of the partition 32 at the respective corners 50, 52. In addition, the bolster members 54, 56 each define a free edge 58, 60 spanning across the respective corners 50, 52.

Referring to FIGS. 3–6, the carrier 10 is shown configured to support a child in either a forward facing (FIGS. 3 and 4) or rearward facing (FIGS. 5 and 6) orientation. It should be noted that throughout the present description, the terms forward facing and rearward facing are used to describe orientations wherein a child is facing outwardly from the back portion 24 and inwardly toward the back portion 24, respectively. Further, it should be noted that the carrier may be supported either to the front or on the back of a person supporting the carrier.

Figure 4:
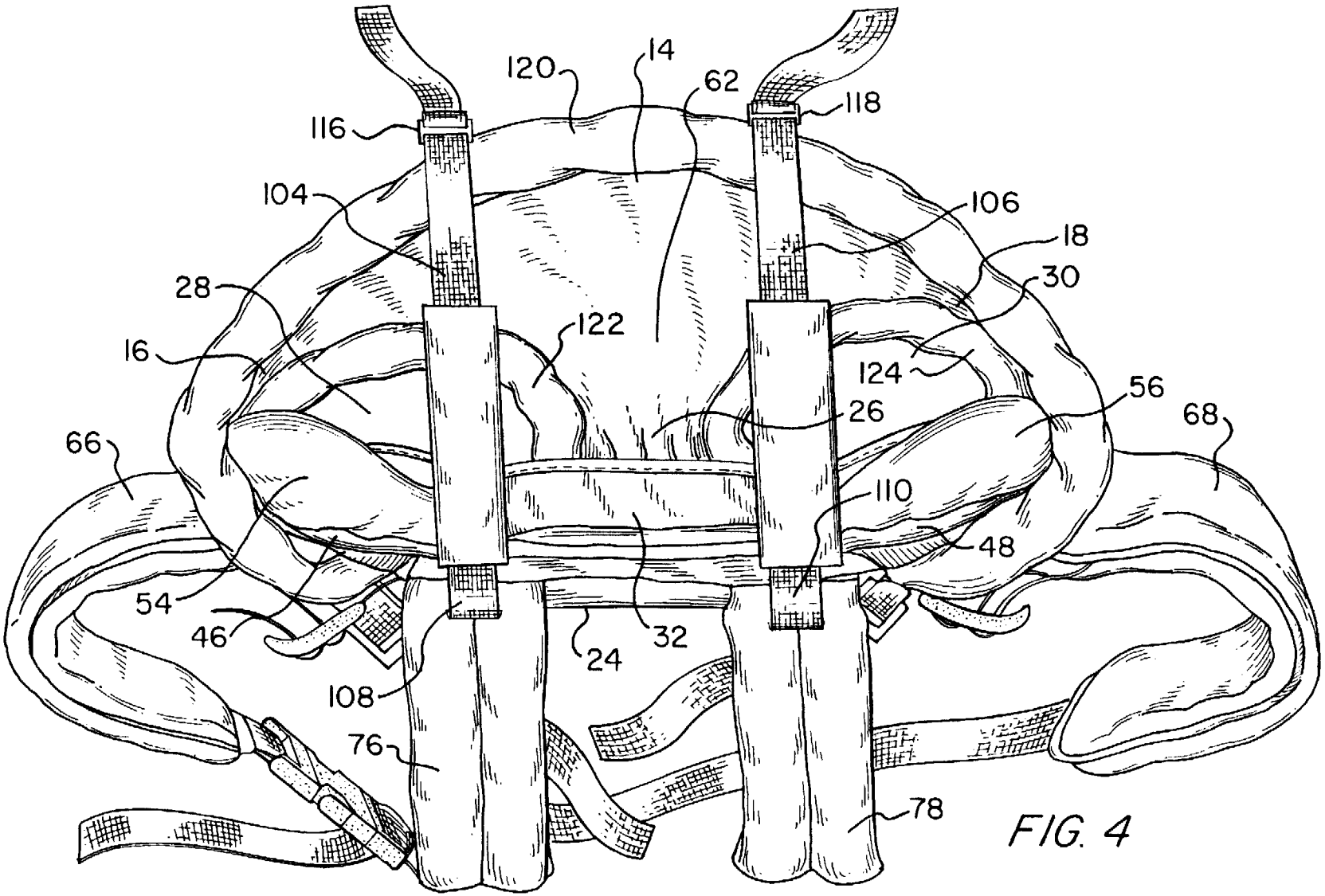
FIG. 4 is a top view of the child carrier showing the central partition located for receiving a child in a forwardly facing position.

As seen in FIGS. 3 and 4, the central partition 32 is located for receiving a forward facing child and is closely adjacent to the back portion 24 whereby a first area 62 is defined between the central partition 32 and the front portion 14 of the soft body member 12. In this position, the wing portions 46, 48 of the central partition 32 angle slightly forwardly from the back portion 24, and the bolster members 54, 56 are positioned extending across the front face 38 to act as cushions for a child's head.

It should be noted that the upper edge of the back portion 24 is substantially even with the upper edge of the front portion 14 and side portions 16, 18 and that the central partition 32 extends above the upper edges of the back portion 24, front portion 14 and side edges 16, 18 to provide a support extending upwardly along the back and head of a child.

Figure 5:
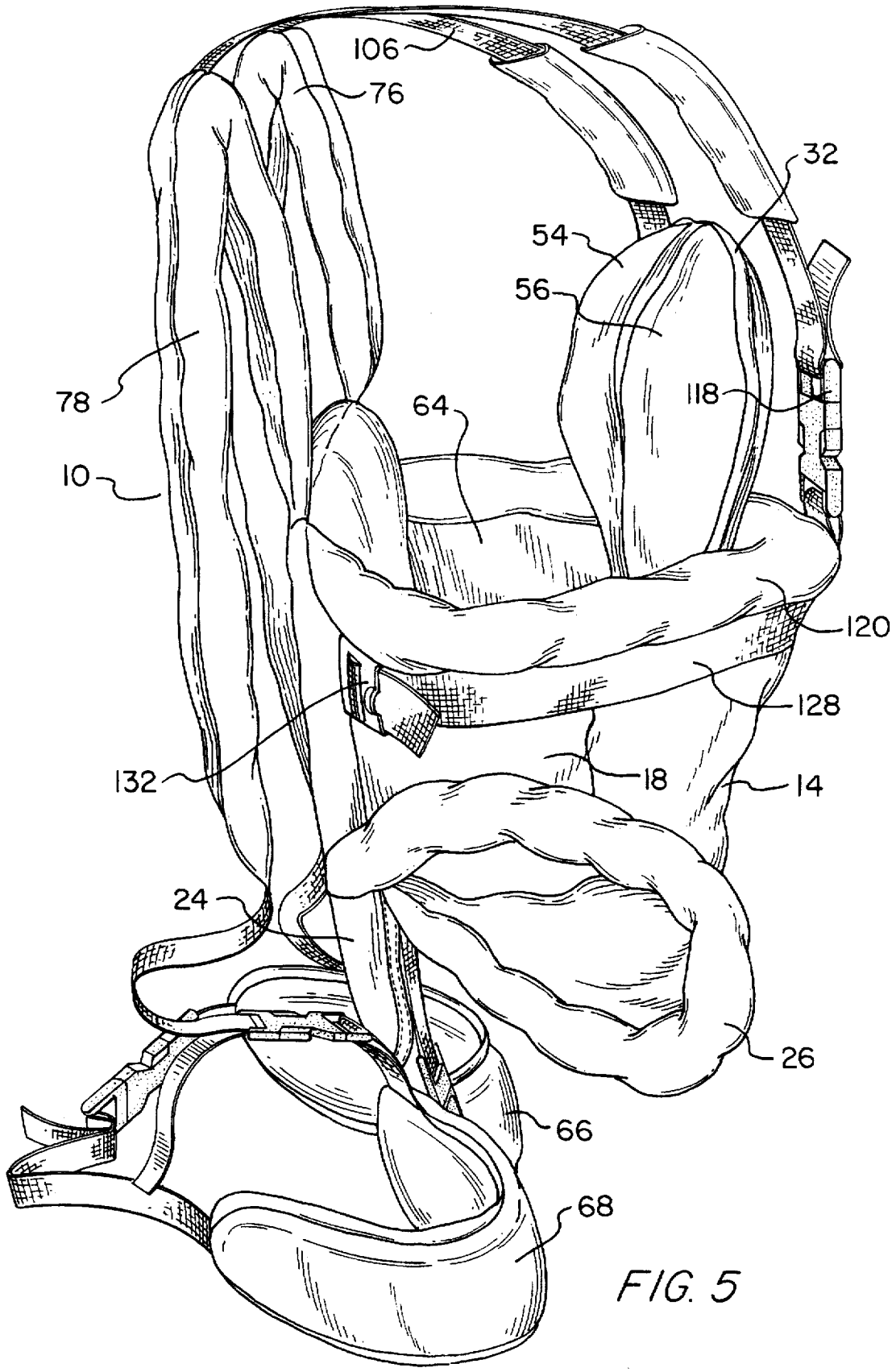
FIG. 5 is a side elevational view of the child carrier showing the central partition located for receiving a child in a rearwardly facing position.
Figure 6:
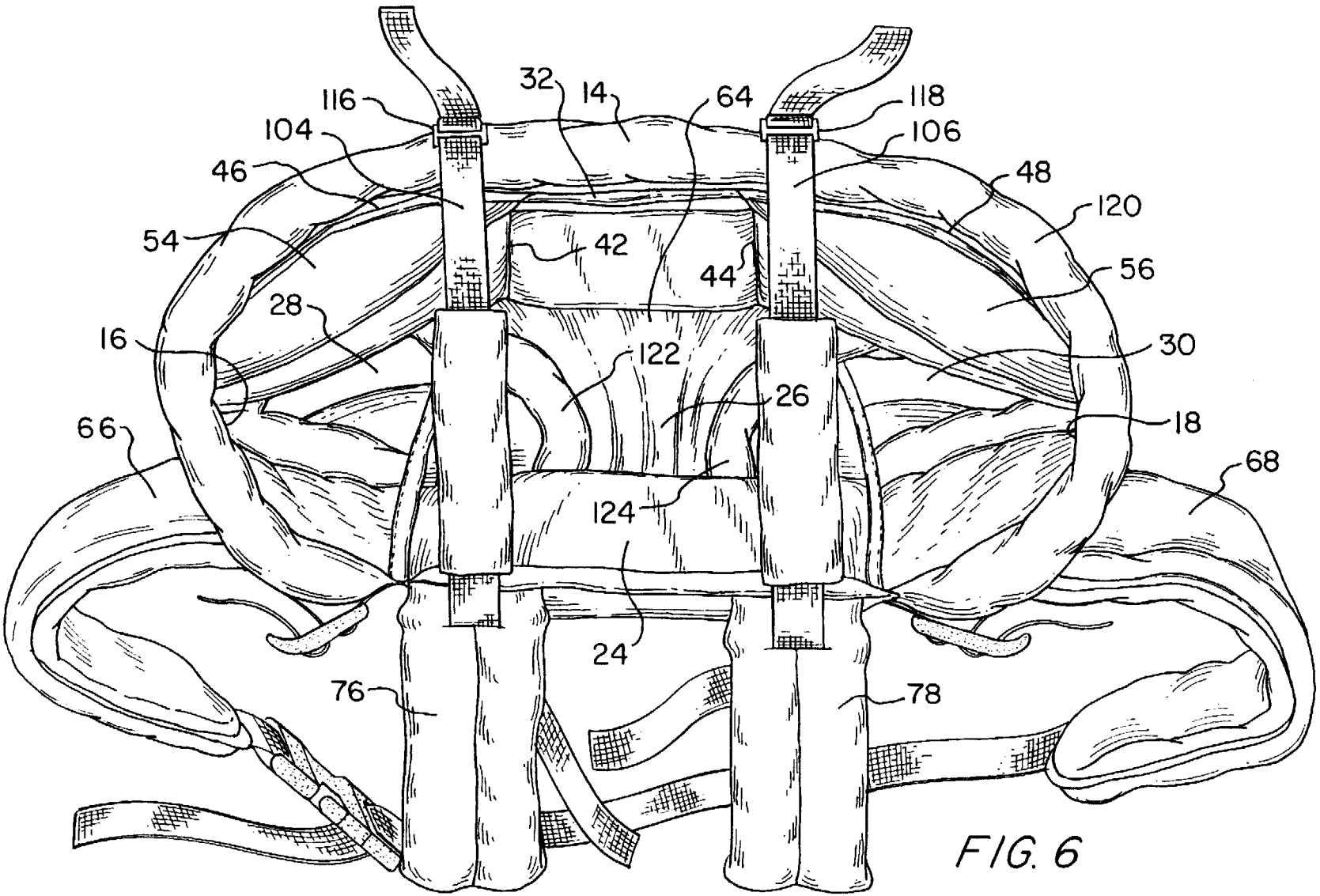
FIG. 6 is a top view of the child carrier showing the central partition located for receiving a child in a rearwardly facing position.

As seen in FIGS. 5 and 6, the central partition 32 has been flexed in an opposite direction from that shown in FIGS. 3 and 4 such that the partition 32 is located in close association with the front portion 14, and the wing portions 46 and 48 extend rearwardly along the side portions 16, 18 toward the back portion 24. A second area 64 is defined between the central partition 32 and the back portion 24 for receiving a child in a rearwardly facing direction. In this position of the central partition 32, the bolster members 54, 56 are positioned extending over the rear face 40 of the partition 32.

Figure 7C:
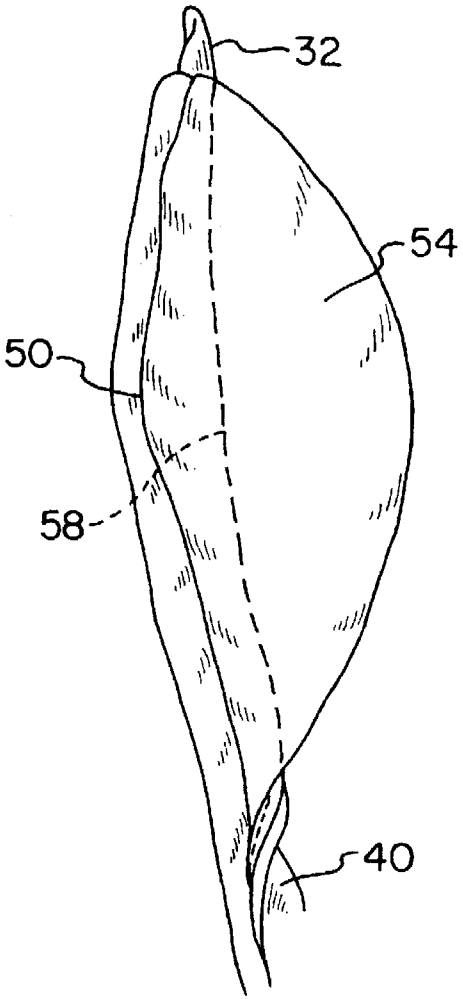
FIGS. 7A–7C are detail views of one of the head bolster members showing manipulation of the bolster member to flip it from a forward face to a rearward face of the central partition.
Figure 7B:
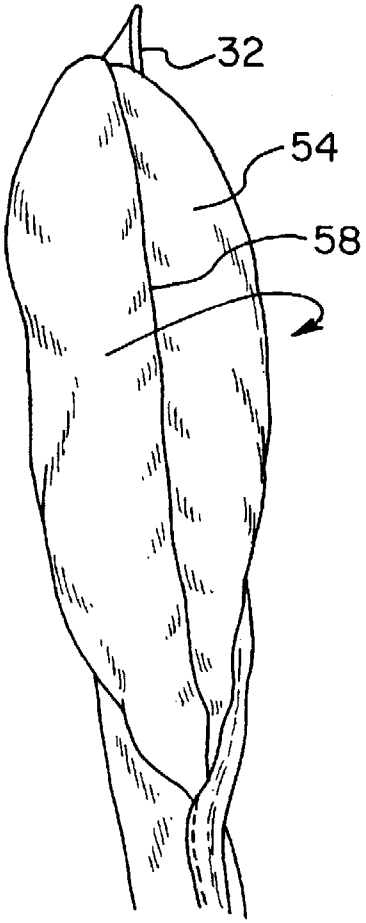
Figure 7A:
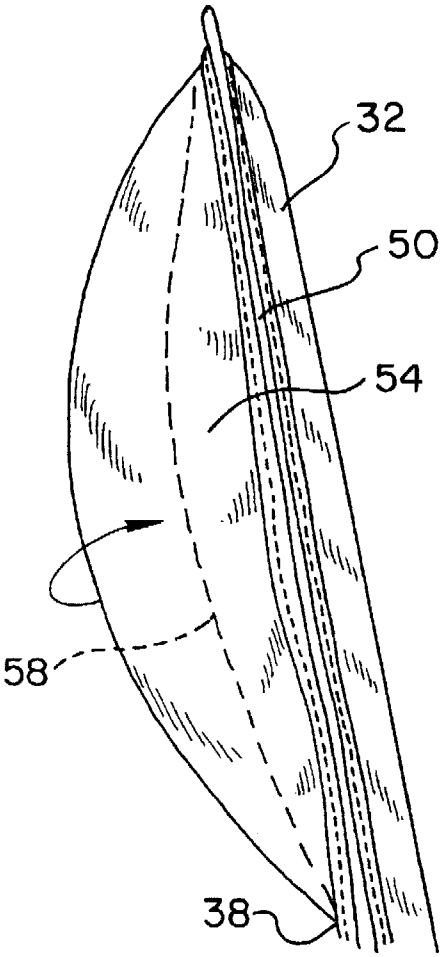

Referring to FIGS. 7A–7C, the operation of positioning the bolster members 54, 56 from a location overlying the front face 38 to a location overlying the rear face 40 is shown with reference to bolster member 54. The free edge 58 of the bolster member 54 is initially lifted to pull it around the corner 50, as illustrated in FIGS. 7A and 7B. Subsequently, the bolster member 54 is flipped down into position overlying the opposing side 40 of the central partition 32. Thus, the bolster members 54, 56 may be used to cushion a child's head regardless of whether the central partition 32 is positioned to define the first area 62 or second area 64 for receiving a child in a forwardly or rearwardly oriented position.

Referring again to FIGS. 1 and 2, a waist belt comprising a pair of waist straps 66, 68 is attached to a lower end of the back portion 24 for extending around the waist of a person supporting the carrier 10. The waist straps 66, 68 carry conventional quick-release snap connector ends 70, 72. In addition, one of the snap connector ends 72 is preferably attached to the waist strap 68 by means of a strap extension 74 which is adjustable along the connector 72 to accommodate different waist sizes.

A pair of shoulder straps 76, 78 are also provided and include respective first ends 80, 82 attached to the upper edge of the back portion, and second ends 84, 86 engaged with the waist belts 66, 68 adjacent to the lower end of the back portion 24. The shoulder straps 76, 78 are provided with quick release connectors 88, 90 adjacent to the second ends 84, 86, and the length of the shoulder straps 76, 78 is adapted to be adjusted at the connectors 88, 90 in a conventional manner.

The back portion 24 is formed as a relatively stiff member and is preferably capable of only limited flexure. The stiff back portion 24 facilitates transferring the weight of a child in the carrier downwardly to the waist straps 66, 68. In this manner, the present carrier 10 provides an advantage associated with frame carriers in that a substantial portion of the weight of a child within the carrier is transferred to the waist straps 66, 68 while the shoulder straps 76, 78 also carry a portion of the child's weight. In this manner, the weight of a child is more evenly distributed across the torso of a person supporting the carrier 10.

Figure 8:
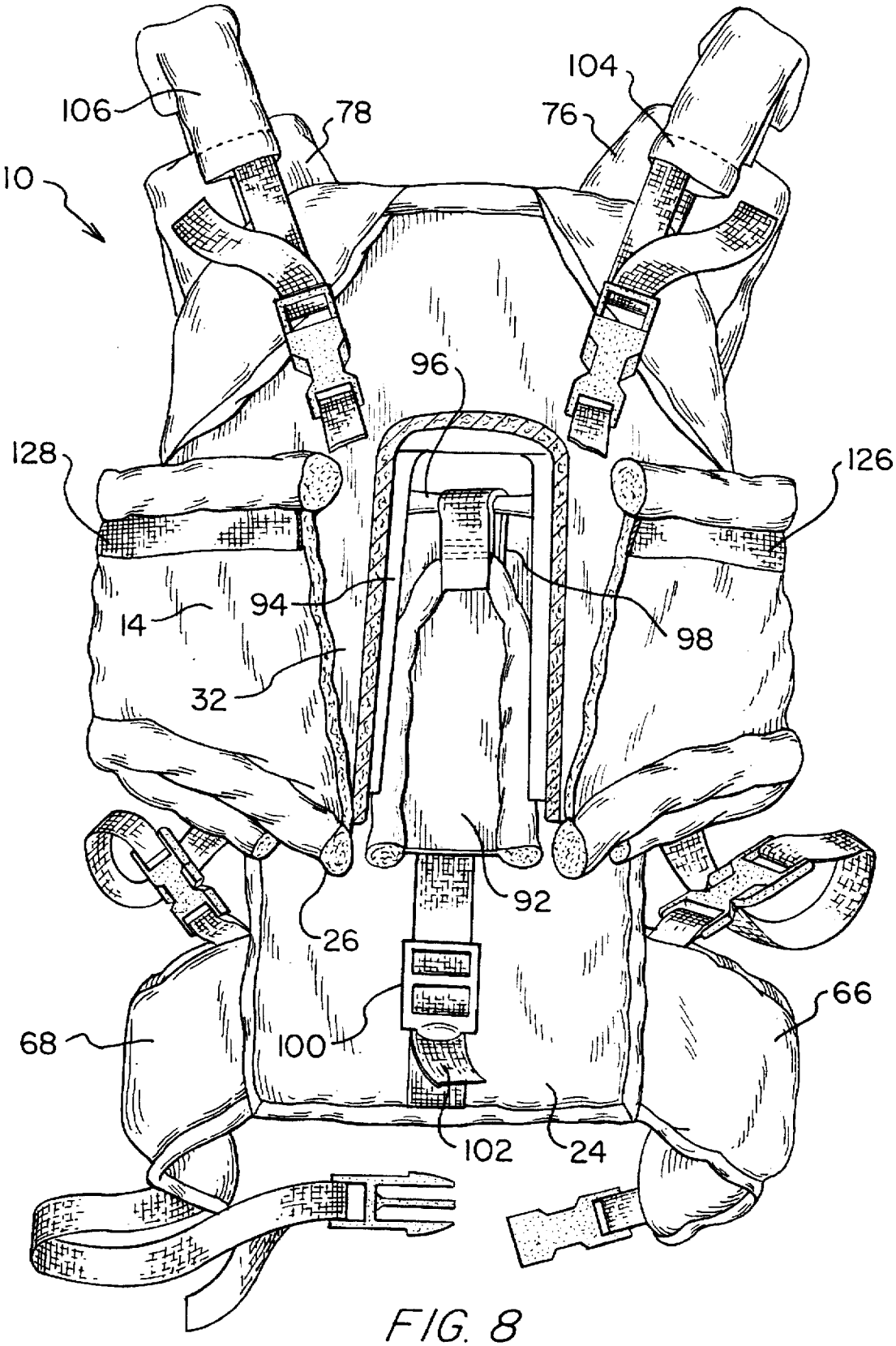
FIG. 8 is a partially cut-away view illustrating the seat adjustment portion of the child carrier.

Referring to FIG. 8, the front portion of the carrier 10 is shown cut-away to illustrate an adjustment means for the seat portion 26 whereby the height of the seat portion 26 may be adjusted. An end portion 92 of the seat portion 26 extends upwardly along the back portion 24 and behind a cover panel 94 which lies over an upper portion of the back portion 24.

A loop 96, such as a strand of material or a cord, is provided with opposing ends thereof attached to the back portion 24. An adjustment strap 98 is attached to the end portion 92 of the seat portion 26 and extends upwardly and around the loop 96. The adjustment strap 98 extends downwardly and is attached to a ladder lock connector 100. The ladder lock 100 is located adjacent to the lower edge of the back portion 24 and is adjustably engaged with a lower strap portion 102 wherein drawing the strap portion 102 through the ladder lock 100 causes the adjustment strap 98 to be pulled toward the lower edge of the back portion 24 whereby the seat portion 26 is drawn upwardly. Releasing the strap 102 causes the adjustment strap 98 to be adjusted upwardly thereby releasing the seat portion 26 to be adjusted downwardly. In this manner, the height of the seat portion 26 may be conveniently adjusted for the size of the child used with the carrier 10.

As may be seen in FIGS. 1 and 3–6, the carrier 10 is further provided with anti-lunge straps 104, 106 having one end 108, 110 attached to the shoulder straps 76, 78 above the upper edge of the central partition 32, and having a second end 112, 114 attached to the front portion 14 of the soft body member. The anti-lunge straps 104, 106 are detachably and adjustably fastened to the front portion 14 by means of quick disconnect connectors 116, 118. The anti-lunge straps limit movement of a child outwardly away from the back portion 24 for children supported in the carrier in both the forward facing and rearwardly facing positions.

The child carrier 10 is further provided with a padded portion 120 along the upper edge of the front portion 14 and side portions 16, 18, as well as padded areas 122, 124 around the circumference of the leg openings 28, 30. The padded portions 120, 122, 124 provide added comfort to a child by avoiding chafing or sharp creases which might result from an unpadded edge. Further, side adjustment straps 126, 128 are provided along the side portions 16, 18. The straps 126, 128 include ladder locks 130, 132 to provide an adjustment for the sides 16, 18 to take up slack or provide additional area depending on the size of the child positioned within the carrier 10.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A child carrier adapted to be supported on a person by a harness, said child carrier comprising:

a soft bodied member defining a front portion and side portions forming a child receiving area;

a back portion, said side portions connected to said back portion;

a seat portion extending from a lower end of said front portion and attached to said back portion; and a central partition extending through said child receiving area, said central partition defining front and rear faces and including side edges extending between said side portions, wherein said central partition is movable between positions adjacent said front and back portions to alternately define first and second areas within said carrier, said first area defined between said front portion and said front face for receiving a forwardly facing child, and said second area defined between said back portion and said rear face for receiving a rearwardly facing child, and wherein said central partition comprises a relatively stiff member and is connected to said side portions for supporting the back of a child.

2. The child carrier as recited in claim 1 including flexure points defined on the partition to facilitate flexing of said central partition such that said central partition may be selectively moved into close association with said front portion and said back portion.

3. The child carrier is recited in claim 1 wherein said central partition defines a front face and a rear face and opposing upper corners, and including a pair of padded bolster members located adjacent to said side edges at said upper corners, wherein each of said bolster members are manipulable to be alternately positioned extending across said front and said rear face at said upper corners.

4. A child carrier adapted to be supported on a person by a harness, said child carrier comprising:

a soft body member defining a front portion and side portions forming a child receiving area;

a back portion defining upper and lower ends, said side portions connected to said back portion;

a seat portion extending from a lower end of said front portion and attached to said back portion; and a waist belt attached to said lower end of said back portion for extending around the waist of a person supporting said carrier;

wherein said back portion is relatively stiff to facilitate transferring the weight of the child in said carrier downwardly to said waist belt; and further including a relatively stiff central partition connected to said side portions and defining front and rear faces wherein said central partition is movable to alternately define first and second areas within said carrier between said from face and said front portion and between said rear face and said back portion for receiving a child.

5. A child carrier adapted to be supported on a person by a harness, said child carrier comprising:

a soft body member defining a front portion and side portions forming a child receiving area;

a back portion defining upper and lower ends, said side portions connected to said back portion;

a loop attached to said back portion; and a seat portion extending from a lower end of said front portion and including an adjustment strap passing through said loop and attaching to said back portion at an attachment location spaced from said loop wherein said adjustment strap is adjustable to adjust the height of said seat portion.

6. The child carrier is recited in claim 5 including a loop attached to said back portion wherein said adjustment strap passes through said loop and attaches to said back portion at an attachment location spaced from said loop, wherein said loop is located near said upper end of said back portion and said attachment location is located near said lower end of said back portion such that pulling down on said adjustment strap increases the height of said seat portion.

7. The child carrier as recited in claim 5 wherein said back portion comprises a relatively stiff board, and including a waist belt having opposing ends attached to said back portion, said relatively stiff board acting to facilitate transferring the weight of a child in said carrier downwardly to said waist belt.

8. The child carrier as recited in claim 5 including a relatively stiff central partition connected to said side portions and defining front and rear faces wherein said central partition is movable to alternately define first and second areas within said carrier between said front face and said front portion and between said rear face and said back portion for receiving a child.

9. A child carrier adapted to be supported on a person by a harness, said child carrier comprising:

a soft body member defining a front portion and side portions forming a child receiving area;

a back portion, said side portions connected to said back portion;

a seat portion extending from a lower end of said front portion and attached to said back portion;

a central partition extending through said child receiving area, said central partition comprising a relatively stiff member and connected to said side portions for supporting the back of a child; and wherein said central partition is located to define a first area between said front portion and said central partition for receiving a forwardly facing child, and to define a second area between said back portion and said central partition for receiving a rearwardly facing child.

10. The child carrier is recited in claim 9 including flexure points defined on the partition to facilitate flexing of said central partition such that said central partition may be selectively moved into close association with said front portion and said back portion.

11. The child carrier is recited in claim 9 wherein said central partition defines a front face and a rear face and opposing upper corners, and including a pair of padded bolster members located adjacent to said side edges at said upper corners, wherein each of said bolster members are manipulable to be alternately positioned extending across said and front and said rear face at said upper corners.

* * * * *